US011322104B2

(12) United States Patent
Chen

(10) Patent No.: US 11,322,104 B2
(45) Date of Patent: May 3, 2022

(54) OVER-DRIVE COMPENSATION METHOD AND DEVICE THEREOF

(71) Applicant: REALTEK SEMICONDUCTOR CORP., Hsinchu (TW)

(72) Inventor: Li-Ang Chen, Hsinchu (TW)

(73) Assignee: REALTEK SEMICONDUCTOR CORP., Hsinchu (TW)

( * ) Notice: Subject to any disclaimer, the term of this patent is extended or adjusted under 35 U.S.C. 154(b) by 0 days.

(21) Appl. No.: 16/809,031

(22) Filed: Mar. 4, 2020

(65) Prior Publication Data

US 2021/0043155 A1 Feb. 11, 2021

(30) Foreign Application Priority Data

Aug. 5, 2019 (TW) ..... 108127799

(51) Int. Cl.
*G09G 3/36* (2006.01)

(52) U.S. Cl.
CPC ... *G09G 3/3648* (2013.01); *G09G 2320/0233* (2013.01); *G09G 2320/0242* (2013.01); *G09G 2320/0252* (2013.01); *G09G 2340/16* (2013.01); *G09G 2360/16* (2013.01); *G09G 2360/18* (2013.01)

(58) Field of Classification Search
CPC ..... G09G 3/3648; G09G 2320/0233; G09G 2320/024; G09G 2320/0252; G09G 2340/16; G09G 2360/16; G09G 2360/18
See application file for complete search history.

(56) References Cited

U.S. PATENT DOCUMENTS 5,784,050 A * 7/1998 Corry ..... G09G 5/363 345/604
6,362,831 B1 * 3/2002 Shyu ..... G09G 5/02 345/591

(Continued)

FOREIGN PATENT DOCUMENTS

CN 105898035 A 8/2016
TW 200717405 A 5/2007

(Continued)

*Primary Examiner* — Michael A Faragalla
*Assistant Examiner* — Sujit Shah
(74) *Attorney, Agent, or Firm* — Birch, Stewart, Kolasch & Birch, LLP

(57) ABSTRACT

This application provides an over-drive compensation method and a device thereof. The over-drive compensation method includes: receiving three primary color information of a current frame, and converting the three primary color information into color space information with luminance, to obtain a current luminance information from the color space information; buffering and storing the current luminance information in a buffer memory and outputting, by the buffer memory, previous luminance information of a previous frame; and generating a luminance over-drive gain value according to the current luminance information and previous luminance information; converting the luminance over-drive gain value into a three primary color over-drive gain value; and generating, according to the three primary color information and the three primary color over-drive gain values, corresponding over-drive compensated values for output to over-drive the liquid crystal display panel.

12 Claims, 4 Drawing Sheets

(56) References Cited

U.S. PATENT DOCUMENTS

| | | | | |
|---|---|---|---|---|
| 9,171,491 | B1 * | 10/2015 | Kwon | G09G 3/3648 |
| 2008/0068359 | A1 * | 3/2008 | Yoshida | G09G 3/3406<br>345/204 |
| 2008/0122769 | A1 * | 5/2008 | Takaki | G09G 3/3648<br>345/87 |
| 2008/0231624 | A1 * | 9/2008 | Poon | G09G 3/3611<br>345/212 |
| 2008/0279470 | A1 * | 11/2008 | Warmuth | G09G 3/3611<br>382/255 |
| 2009/0052772 | A1 * | 2/2009 | Speirs | G09G 3/2092<br>382/166 |
| 2013/0010014 | A1 * | 1/2013 | Hasegawa | G09G 3/3607<br>345/690 |
| 2016/0104444 | A1 * | 4/2016 | Miyata | G09G 3/3413<br>345/205 |
| 2017/0330498 | A1 * | 11/2017 | Orio | G09G 3/3607 |

FOREIGN PATENT DOCUMENTS

| | | | |
|---|---|---|---|
| TW | 200727220 | A | 7/2007 |
| TW | 201118843 | A1 | 6/2011 |
| TW | 201506897 | A | 2/2015 |

* cited by examiner

OVER-DRIVE COMPENSATION METHOD AND DEVICE THEREOF

CROSS-REFERENCE TO RELATED APPLICATION

This non-provisional application claims priority under 35 U.S.C. § 119(a) to patent application Ser. No. 10/812,7799 in Taiwan, R.O.C. on Aug. 5, 2019, the entire contents of which are hereby incorporated by reference.

BACKGROUND

Technical Field

This application relates to a drive technology for liquid crystal displays, and in particular, to an over-drive compensation method that may reduce response time of the liquid crystal displays and a device thereof.

Related Art

In a general liquid crystal display, the over-drive (OD) technology is widely used to reduce a response time of the liquid crystal display. In the technology, an over-drive gain value is generated according to a pixel value of a current frame and a pixel value of a previous frame of each pixel, and a corresponding liquid crystal molecule is driven by adding the over-drive gain value to the pixel value outputted by the current frame, thereby increasing a turning speed of the liquid crystal molecule, so as to improve the response time of the liquid crystal display.

For over-drive compensation, the liquid crystal display generally needs to store the pixel value of the previous frame by using a temporary space, so as to compare the pixel value of the previous frame with the pixel value of the current frame and determine an over-drive gain value. Three primary color (RGB) channels are generally stored separately during storage, and compared to obtain respective gain values. However, it is required to store pixel information of the three primary color channels. Therefore, a relatively large temporary space is required, that is, additional costs are caused due to a relatively large demand for a memory size and bandwidth. In addition, because the three primary color channels are compensated respectively, when the over-drive gain values are relatively large and toward different directions, overcompensation may happen and an opposite color smear appears in the frame as a result.

SUMMARY

In view of this, this application provides an over-drive compensation method, applicable to a liquid crystal display panel. The over-drive compensation method includes: receiving three primary color information of a current frame, and converting the three primary color information into color space information with luminance, to obtain a current luminance information from the color space information; buffering and storing the current luminance information in a buffer memory, and outputting, by the buffer memory, previous luminance information of a previous frame; generating a luminance over-drive gain value according to the current luminance information and the previous luminance information; converting the luminance over-drive gain value into three primary color over-drive gain values; and generating, according to the three primary color information and the three primary color over-drive gain values, a corresponding over-drive compensated value for output to over-drive the liquid crystal display panel.

According to some embodiments, a gain comparison table is queried according to the current luminance information and the previous luminance information, to generate the luminance over-drive gain value.

This application further provides an over-drive compensation device, applicable to a liquid crystal display panel. The over-drive compensation device includes a first conversion circuit, a buffer memory, a look-up table operation circuit, a second conversion circuit and a generator. The first conversion circuit is configured to receive three primary color information of a current frame, and convert the three primary color information into color space information with luminance to obtain current luminance information from the color space information. The buffer memory is electrically connected to the first conversion circuit and configured to buffer and store the current luminance information and output previous luminance information of a previous frame. The look-up table operation circuit is electrically connected to the first conversion circuit and the buffer memory, and is configured to generate a luminance over-drive gain value by table look-up according to the current luminance information and the previous luminance information. The second conversion circuit is electrically connected to the look-up table operation circuit to convert the luminance over-drive gain value into three primary color over-drive gain values. The generator is electrically connected to the second conversion circuit and is configured to receive the three primary color information and generate, according to the three primary color information and the three primary color over-drive gain values, a corresponding over-drive compensated value for output to over-drive the liquid crystal display panel.

According to some embodiments, the previous luminance information has been stored in the buffer memory in advance. The current luminance information replaces the previous luminance information and is stored in the buffer memory as previous luminance information corresponding to a next frame.

According to some embodiments, the previous luminance information or the current luminance information stored in the buffer memory needs to be first compressed. After the buffer memory outputs the previous luminance information, the previous luminance information is first decompressed.

According to some embodiments, the three primary color information is converted into the color space information by using a first conversion matrix, the luminance over-drive gain value is converted into the three primary color over-drive gain values by using a second conversion matrix, and the first conversion matrix and the second conversion matrix are inverse matrices to each other.

According to some embodiments, the look-up table operation circuit further includes a gain comparison table, so as to query the gain comparison table according to the current luminance information and the previous luminance information.

According to some embodiments, the three primary color over-drive gain $$\begin{cases} \Delta_R = r_y \Delta_Y \\ \Delta_G = g_y \Delta_Y, \\ \Delta_B = b_y \Delta_Y \end{cases}$$

values are represented as where $\Delta_R$, $\Delta_G$ and $\Delta_B$ are the three primary color over-drive gain values, $\Delta_Y$ is the luminance over-drive gain value, and $r_y$, $g_y$ and $b_y$ are three primary color luminance conversion coefficients.

Based on the above, in this application, demands for a memory resource and bandwidth can be reduced when over-drive compensation is performed for a liquid crystal display, and an effect of over-drive compensation is also achieved. In addition, in this application, a smear phenomenon caused by overcompensation can be avoided. Therefore, frame quality can be effectively maintained.

DETAILED DESCRIPTION

Figure 1:
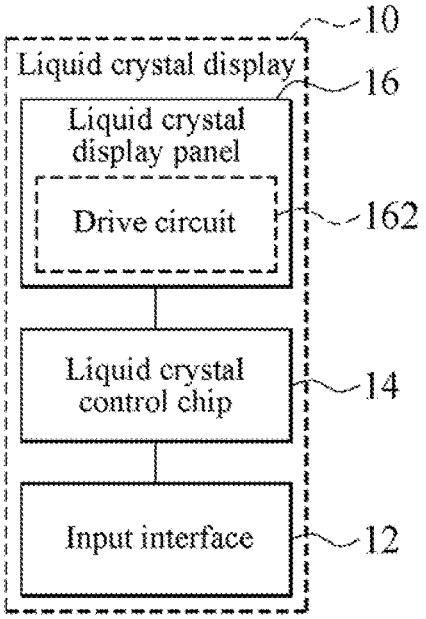
FIG. 1 is a block diagram of a liquid crystal display according to an embodiment of this application.

An over-drive compensation method and an over-drive compensation device provided in this application are applied to a liquid crystal display. The liquid crystal display 10 is shown in FIG. 1, and the liquid crystal display 10 includes an input interface 12, a liquid crystal control chip (scaler) 14, and a liquid crystal display panel 16. The input interface 12 can receive an external video signal. A format of the video signal may be but not limited to a DisplayPort (DP) signal, a high definition multimedia interface (HDMI) signal, a video graphics array (VGA) and the like. The liquid crystal control chip 14 is electrically connected to the input interface 12 and the liquid crystal display panel 16, so as to receive the video signal and convert the video signal into a panel signal that can be displayed on the liquid crystal display panel 16. A format of the panel signal may be but not limited to a low voltage differential signal (LVDS), an Embedded DisplayPort (eDP) signal, a V-by-one signal and the like. A drive circuit 162 in the liquid crystal display panel 16 drives, according to the panel signal, the liquid crystal display panel 16 to display frames.

Figure 2:
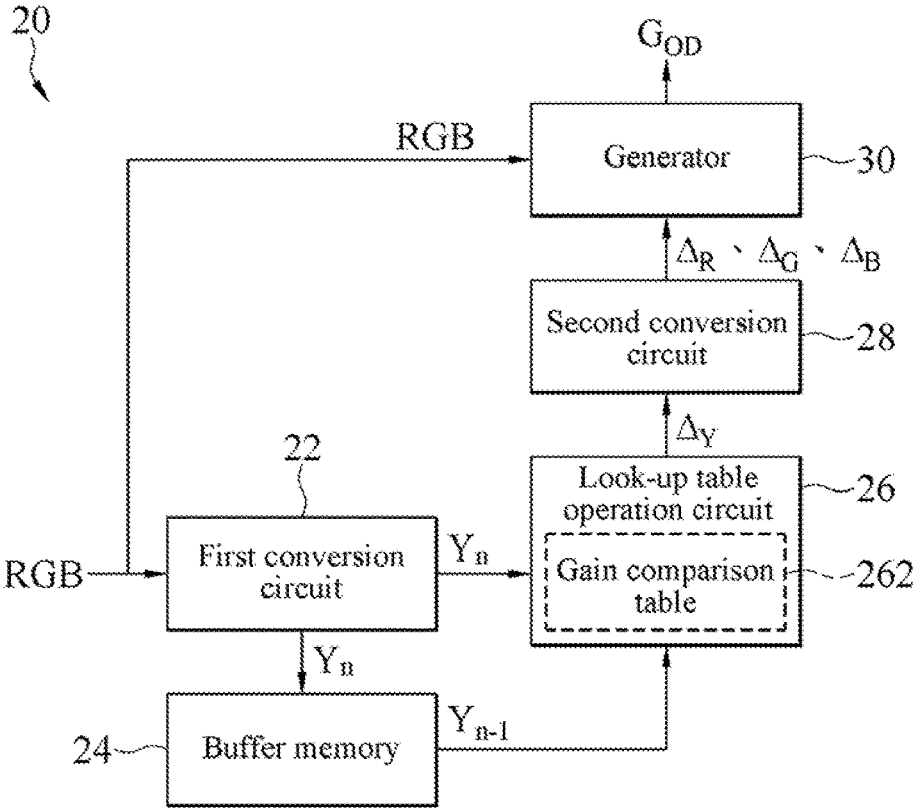
FIG. 2 is a block diagram of an over-drive compensation device according to an embodiment of this application.

FIG. 2 is a block diagram of an over-drive compensation device according to an embodiment of this application. Referring to FIG. 2, the over-drive compensation device 20 includes a first conversion circuit 22, a buffer memory 24, a look-up table operation circuit 26, a second conversion circuit 28, and a generator 30. The first conversion circuit 22 is electrically connected to the buffer memory 24 and a look-up table operation circuit 26, and the buffer memory 24 is also electrically connected to the look-up table operation circuit 26. The look-up table operation circuit 26 is electrically connected to the second conversion circuit 28, and the second conversion circuit 28 is further electrically connected to the generator 30. In an embodiment, the over-drive compensation circuit 20 may be disposed in the liquid crystal control chip 14 in FIG. 1 to over-drive the liquid crystal display panel 16.

In an embodiment, the first conversion circuit 22 is configured to receive three primary color information of each display frame, and each display frame may be referred to as a previous input frame and a current input frame according to a chronological order.

In an embodiment, the buffer memory 24 can be a volatile memory, such as a random access memory (RAM) and a static random access memory (SRAM).

In an embodiment, the generator 30 is an adder.

Figure 3:
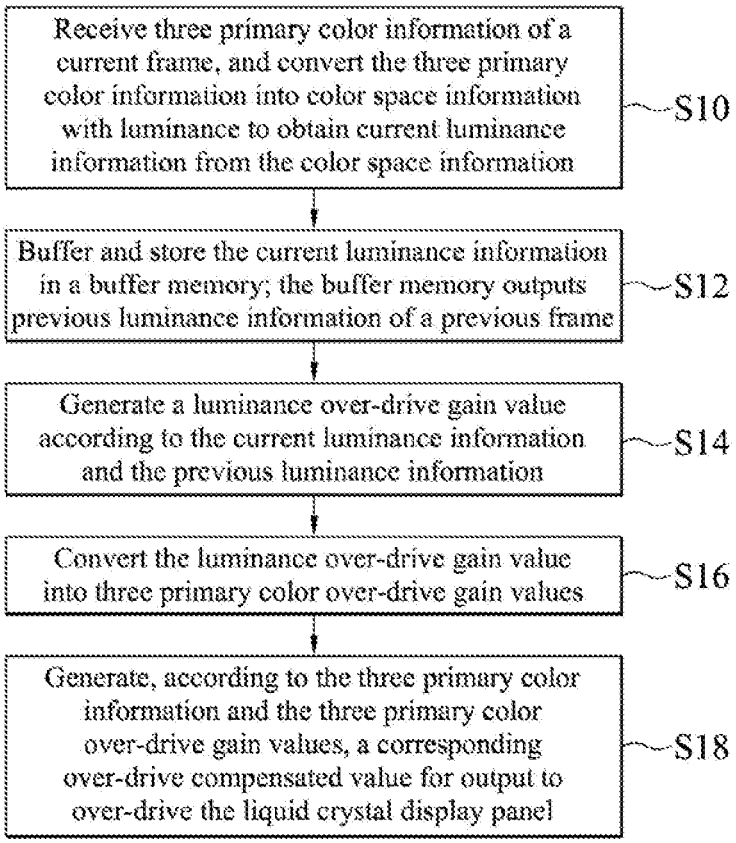
FIG. 3 is a flowchart of an over-drive compensation method according to an embodiment of this application.

FIG. 3 is a flowchart of an over-drive compensation method according to an embodiment of this application. Referring to all FIG. 1, FIG. 2 and FIG. 3, the over-drive compensation method includes the following steps: as shown in step S10, the first conversion circuit 22 receives three primary color information RGB of a current frame, converts the three primary color information RGB into color space information YC1C2 with luminance to obtain current luminance information $Y_n$ from the color space information YC1C2, and outputs the current luminance information $Y_n$ to the buffer memory 24 and the look-up table operation circuit 26. In an embodiment, a color space is a color space where luminance and chroma are separated. The color space may be but not limited to color spaces such as YCbCr, YCgCo, and YUV, to obtain the color space information YC corresponding to the color space. The color space information YC1C2 includes luminance information Y and dichroism information C1C2. In this embodiment, only the luminance information Y in the color space information YC1C2 is used for subsequent processing.

As shown in step S12, the current luminance information $Y_n$ outputted by the first conversion circuit 22 is buffered and stored in the buffer memory 24, and the buffer memory 24 outputs previous luminance information $Y_{n-1}$ of a previous frame to the look-up table operation circuit 26. In an embodiment, the previous luminance information $Y_{n-1}$ of the previous frame has been stored in the buffer memory 24 in advance. Therefore, when the first conversion circuit 22 outputs the current luminance information $Y_n$ to the look-up table operation circuit 26, the buffer memory 24 also transmits the previous luminance information $Y_{n-1}$ to the look-up table operation circuit 26. After the buffer memory 24 outputs the previous luminance information $Y_{n-1}$ to the look-up table operation circuit 26, the current luminance information $Y_n$ outputted by the first conversion circuit 22 may further replace the previous luminance information $Y_{n-1}$ and is stored in the buffer memory 24 as previous luminance information corresponding to a next frame.

As shown in step S14, after the look-up table operation circuit 26 receives the current luminance information $Y_n$ and the previous luminance information $Y_{n-1}$, the look-up table operation circuit 26 generates a luminance over-drive gain value $\Delta_Y$ according to the current luminance information $Y_n$ and the previous luminance information $Y_{n-1}$, and outputs the luminance over-drive gain value $\Delta_Y$ to the second conversion circuit 28. In an embodiment, the look-up table operation circuit 26 includes a gain comparison table 262, so as to query the gain comparison table 262 according to the current luminance information $Y_n$ and the previous luminance information $Y_{n-1}$ to obtain a luminance over-drive gain value $\Delta_Y$.

In an embodiment, over-drive gain values corresponding to the previous luminance information $Y_{n-1}$ to the current luminance information $Y_n$ are pre-stored in the gain comparison table 262 to shorten a response time required. In addition, the over-drive gain values in the gain comparison table 262 are prepared in advance, and the over-drive gain values corresponding to the previous luminance information $Y_{n-1}$ to the current luminance information $Y_n$ may be obtained through a correction training process to establish the last stored luminance over-drive gain value of the gain comparison table 262. Therefore, in the look-up table operation circuit 26, the look-up table operation circuit 26 may query the gain comparison table 262 according to the current luminance information and the previous luminance information $Y_{n-1}$ to obtain a corresponding luminance over-drive gain value $\Delta_Y$.

As shown in step S16, the second conversion circuit 28 converts the luminance over-drive gain value $\Delta_Y$ into three primary color over-drive gain values $\Delta_R$, $\Delta_G$ and $\Delta_B$, and the three primary color over-drive gain values $\Delta_R$, $\Delta_G$ and $\Delta_B$ are transmitted to the generator 30.

As shown in step S18, the generator 30 generates, according to the three primary color information RGB and the three primary color over-drive gain values $\Delta_R$, $\Delta_G$ and $\Delta_B$, an over-drive compensated value $G_{OD}$ for output. The over-drive compensated value $G_{OD}$ includes $R+\Delta_R$, $G+\Delta_G$ and $B+\Delta_B$, to use the over-drive compensated value $G_{OD}$ to over-drive the liquid crystal display panel 16 so that the liquid crystal display panel 16 displays a frame.

In an embodiment, in step S10, the first conversion circuit 22 converts the three primary color information RGB into the color space information YC1C2 by using a 3*3 first conversion matrix X1. In step S16, the second conversion circuit 28 converts the luminance over-drive gain value $\Delta_Y$ into the three primary color over-drive gain values $\Delta_R$, $\Delta_G$ and $\Delta_B$ by using a 3*3 second conversion matrix X2, and the first conversion matrix X1 and the second conversion matrix X2 are inverse matrices to each other.

For example, the first conversion matrix X1 is $$\begin{bmatrix} y_r & y_g & y_b \\ c_{1,r} & c_{1,g} & c_{1,b} \\ c_{2,r} & c_{2,g} & c_{2,b} \end{bmatrix},$$

and the second conversion matrix X2 is $$\begin{bmatrix} r_y & r_{c1} & r_{c2} \\ g_y & g_{c1} & g_{c2} \\ b_y & b_{c1} & b_{c2} \end{bmatrix}.$$

Therefore, the first conversion circuit 22 may convert the three primary color information RGB into the color space information TC1C2 by using the first conversion matrix X1, and the second conversion circuit 28 may convert the color space information YC1C2 into RGB space by using the second conversion matrix X2, as shown in the following:

$$\begin{bmatrix} Y \\ C1 \\ C2 \end{bmatrix} = \begin{bmatrix} y_r & y_g & y_b \\ c_{1,r} & c_{1,g} & c_{1,b} \\ c_{2,r} & c_{2,g} & c_{2,b} \end{bmatrix} \begin{bmatrix} R \\ G \\ B \end{bmatrix}$$

$$\begin{bmatrix} R \\ G \\ B \end{bmatrix} = \begin{bmatrix} r_y & r_{c1} & r_{c2} \\ g_y & g_{c1} & g_{c2} \\ b_y & b_{c1} & b_{c2} \end{bmatrix} \begin{bmatrix} Y \\ C1 \\ C2 \end{bmatrix}.$$

The first conversion matrix X1 and the second conversion matrix X2 are inverse matrices to each other and meet the following:

$$\begin{bmatrix} r_y & r_{c1} & r_{c2} \\ g_y & g_{c1} & g_{c2} \\ b_y & b_{c1} & b_{c2} \end{bmatrix} \begin{bmatrix} y_r & y_g & y_b \\ c_{1,r} & c_{1,g} & c_{1,b} \\ c_{2,r} & c_{2,g} & c_{2,b} \end{bmatrix} = \begin{bmatrix} 1 & 0 & 0 \\ 0 & 1 & 0 \\ 0 & 0 & 1 \end{bmatrix}.$$

During over-drive compensation calculation, only the luminance information Y is reserved to obtain the luminance over-drive gain value $\Delta_Y$ by calculation, and $Y+\Delta_Y$ may be obtained according to the outputted over-drive compensated value. However, because the liquid crystal display panel 16 is driven by the three primary color information RGB, another conversion process is required to convert the compensated over-drive compensated value from luminance information Y to the RGB space, as shown in the following:

$$\begin{bmatrix} R+\Delta_R \\ G+\Delta_G \\ B+\Delta_B \end{bmatrix} = \begin{bmatrix} r_y & r_{c1} & r_{c2} \\ g_y & g_{c1} & g_{c2} \\ b_y & b_{c1} & b_{c2} \end{bmatrix} \begin{bmatrix} Y+\Delta_Y \\ C1 \\ C2 \end{bmatrix}$$

$$\Rightarrow \begin{cases} \Delta_R = r_y\Delta_Y \\ \Delta_G = g_y\Delta_Y \\ \Delta_B = b_y\Delta_Y \end{cases}.$$

According to the above, it can be learned by analogy that the conversion coefficients in the second conversion matrix X2 may convert the luminance over-drive gain value $\Delta_Y$ into the RGB space. Therefore, the second conversion circuit 28 may convert the luminance over-drive gain value $\Delta_Y$ into the three primary color over-drive gain values $\Delta_R$, $\Delta_G$ and $\Delta_B$ by using the formula between the luminance over-drive gain value $\Delta_Y$ and the three primary color over-drive gain values $\Delta_R$, $\Delta_G$ and $\Delta_B$, that is $$\begin{cases} \Delta_R = r_y\Delta_Y \\ \Delta_G = g_y\Delta_Y \\ \Delta_B = b_y\Delta_Y \end{cases},$$

and $r_y$, $g_y$ and $b_y$ are three primary color luminance conversion coefficients.

Because in this application, an over-drive compensation operation is performed on only the luminance information Y, the fixed chroma of the panel signal (the over-drive compensated value $G_{OD}$) outputted to the liquid crystal display panel 16 may still remain, so that a potential risk of color cast caused by overcompensation can be prevented.

Figure 4:
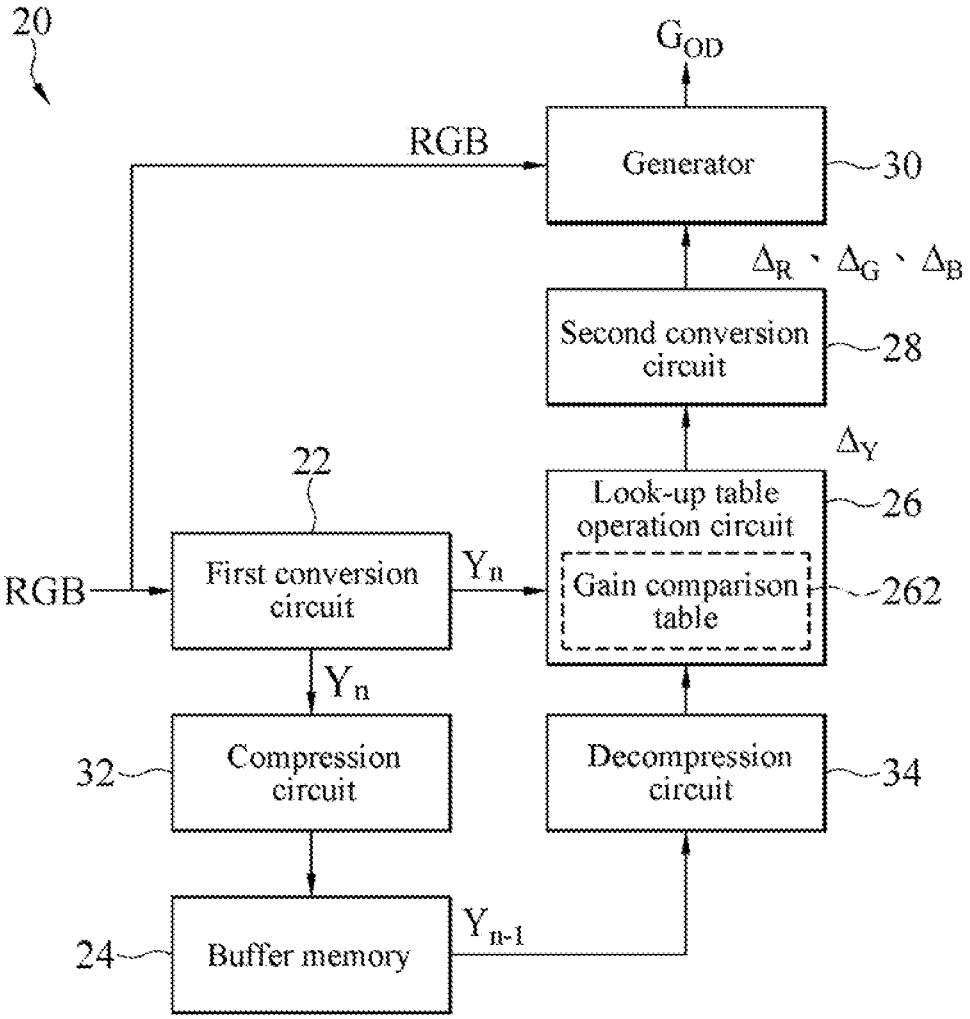
FIG. 4 is a block diagram of an over-drive compensation device according to another embodiment of this application.

On the other hand, to reduce the temporary space used by the buffer memory 24, the luminance information stored in the buffer memory 24 may be first compressed. FIG. 4 is a block diagram of an over-drive compensation device according to another embodiment of this application. Referring to FIG. 4, the over-drive compensation device 20 further includes a compression circuit 32 and a decompression circuit 34. The compression circuit 32 is electrically connected to the first conversion circuit 22 and the buffer memory 24 to compress the previous luminance information or the current luminance information. The compression process may be but not limited to data precision compression or spatial resolution compression. The decompression circuit 34 is electrically connected to the buffer memory 24 and the look-up table operation circuit 26, so that the previous luminance information $Y_{n-1}$ may be first decompressed by the decompression circuit 34 before being transmitted to the look-up table operation circuit 26.

Figure 5:
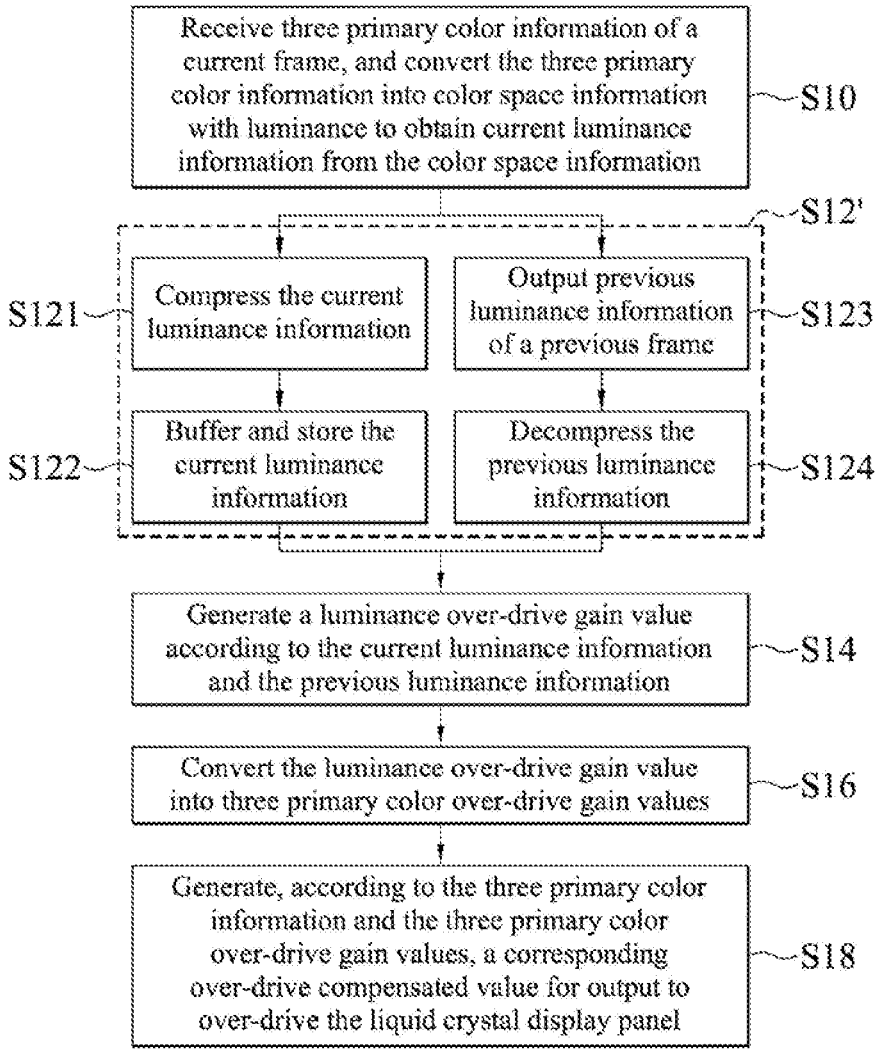
FIG. 5 is a flowchart of an over-drive compensation method according to another embodiment of this application.

FIG. 5 is a flowchart of an over-drive compensation method according to another embodiment of this application. Referring to both FIG. 4 and FIG. 5, as shown in step S10, a first conversion circuit 22 receives three primary color information of a current frame, and converts the three primary color information RGB into color space information YC to obtain current luminance information $Y_n$ from the color space information YC1C2. Then the first conversion circuit 22 outputs the current luminance information $Y_n$ to a compression circuit 32 and a look-up table operation circuit 26.

As shown in step S12', step S12' is divided into steps S121 to S122 and steps S123 to S124 because of compression and decompression. As shown in step S121, the compression circuit 32 compresses the current luminance information $Y_n$. As shown in step S122, after the compression, the current luminance information $Y_n$ is transmitted to a buffer memory 24 from the compression circuit 32, and is buffered and stored in the buffer memory 24. Before or while steps S121 and S122 are performed, steps S123 and S124 are also performed. As shown in step S123, the previous luminance information $Y_{n-1}$ of the previous frame originally stored in the buffer memory 24 has been compressed in advance. Therefore, the buffer memory 24 first outputs the previous luminance information $Y_{n-1}$ of the previous frame to a decompression circuit 34, and as shown in step S124, decompresses the previous luminance information $Y_{n-1}$ of the previous frame by using the decompression circuit 34 and outputs the decompressed previous luminance information $Y_{n-1}$ to the look-up table operation circuit 26 for subsequent processing. Subsequent steps S14 to S18 are the same as those in the flowchart shown in FIG. 3. Therefore, refer to the foregoing detailed descriptions, and details are not described again herein.

Therefore, in this application, when over-drive compensation is performed, only information (brightness information) of one channel needs to be recorded. The storage space needed becomes only one third of the storage space needed when RGB channels are stored respectively, thereby reducing demands for memory space and bandwidth. Therefore, in this application, the effect of over-drive compensation can also be achieved under the premise of reducing the demands for a memory resource and bandwidth. In addition, in this application, a smear phenomenon caused by overcompensation can be avoided. Therefore, frame quality can be effectively maintained.

The foregoing embodiments are merely to describe the technical ideas and characteristics of this application, and are directed to help a person skilled in the art understand and implement the content of this application. The embodiments should not be used to limit the patent scope of this application, that is, any equivalent change or modification made according to the spirit disclosed in this application shall fall within the patent scope of this application.

What is claimed is:

1. An over-drive compensation method, applicable to a liquid crystal display panel, the over-drive compensation method comprising:

receiving three primary color information of a current frame, and converting the three primary color information into color space information with luminance, to obtain current luminance information from the color space information;

buffering and storing the current luminance information in a buffer memory, and outputting, by the buffer memory, previous luminance information of a previous frame;

generating a luminance over-drive gain value according to the current luminance information and the previous luminance information;

converting the luminance over-drive gain value into three primary color over-drive gain values; and generating, according to the three primary color information and the three primary color over-drive gain values, a corresponding over-drive compensated value for output to over-drive the liquid crystal display panel;

wherein the previous luminance information has been stored in the buffer memory in advance, and in the step of buffering and storing the current luminance information, the current luminance information replaces the previous luminance information and is stored in the buffer memory as previous luminance information corresponding to a next frame; and wherein the three primary color information is converted into the color space information by using a first conversion matrix which is $$\begin{bmatrix} y_r & y_g & y_b \\ c_{1,r} & c_{1,g} & c_{1,b} \\ c_{2,r} & c_{2,g} & c_{2,b} \end{bmatrix},$$

and the luminance over-drive gain value is converted into the three primary color over-drive gain values by using a second conversion matrix which is $$\begin{bmatrix} r_y & r_{c1} & r_{c2} \\ g_y & g_{c1} & g_{c2} \\ b_y & b_{c1} & b_{c2} \end{bmatrix}.$$

2. The over-drive compensation method according to claim 1, wherein the step of generating the luminance over-drive gain value according to the current luminance information and the previous luminance information further comprises querying a gain comparison table according to the current luminance information and the previous luminance information, to generate the luminance over-drive gain value.

3. The over-drive compensation method according to claim 1, wherein the previous luminance information is first compressed before being stored in the buffer memory, and after the buffer memory outputs the previous luminance information, the previous luminance information is first decompressed.

4. The over-drive compensation method according to claim 1, wherein before the step of buffering and storing the current luminance information, the current luminance information is compressed.

5. The over-drive compensation method according to claim 1, wherein the first conversion matrix and the second conversion matrix are inverse matrices to each other.

6. The over-drive compensation method according to claim 1, wherein the three primary color over-drive gain values are represented as $$\begin{cases} \Delta_R = r_y \Delta_Y \\ \Delta_G = g_y \Delta_Y \\ \Delta_B = b_y \Delta_Y \end{cases},$$

wherein $\Delta_R$, $\Delta_G$ and $\Delta_B$ are the three primary color over-drive gain values, $\Delta_Y$ is the luminance over-drive gain value, and $r_y$, $g_y$ and $b_y$ are three primary color luminance conversion coefficients.

7. An over-drive compensation device, applicable to a liquid crystal display panel, the over-drive compensation device comprising:

a first conversion circuit, configured to receive three primary color information of a current frame, and convert the three primary color information into color space information with luminance to obtain current luminance information from the color space information;

a buffer memory, electrically connected to the first conversion circuit and configured to buffer and store the current luminance information and output previous luminance information of a previous frame;

a look-up table operation circuit, electrically connected to the first conversion circuit and the buffer memory and configured to generate a luminance over-drive gain value by table look-up according to the current luminance information and the previous luminance information;

a second conversion circuit, electrically connected to the look-up table operation circuit to convert the luminance over-drive gain value into three primary color over-drive gain values; and a generator, electrically connected to the second conversion circuit and configured to receive the three primary color information and generate, according to the three primary color information and the three primary color over-drive gain values, a corresponding over-drive compensated value for output to over-drive the liquid crystal display panel;

wherein the previous luminance information has been stored in the buffer memory in advance, and the current luminance information replaces the previous luminance information, and is stored in the buffer memory as previous luminance information corresponding to a next frame; and wherein the first conversion circuit converts the three primary color information into the color space information by using a first conversion matrix which is $$\begin{bmatrix} y_r & y_g & y_b \\ c_{1,r} & c_{1,g} & c_{1,b} \\ c_{2,r} & c_{2,g} & c_{2,b} \end{bmatrix},$$

and the second conversion circuit converts the luminance over-drive gain value into the three primary color over-drive gain values by using a second conversion matrix which is $$\begin{bmatrix} r_y & r_{c1} & r_{c2} \\ g_y & g_{c1} & g_{c2} \\ b_y & b_{c1} & b_{c2} \end{bmatrix}.$$

8. The over-drive compensation device according to claim 7, wherein the look-up table operation circuit comprises a gain comparison table, to query the gain comparison table according to the current luminance information and the previous luminance information.

9. The over-drive compensation device according to claim 7, further comprising:

a compression circuit, electrically connected to the first conversion circuit and the buffer memory to compress the previous luminance information and the current luminance information; and a decompression circuit, electrically connected to the buffer memory and the look-up table operation circuit so that the previous luminance information is decompressed before the previous luminance information is transmitted to the look-up table operation circuit.

10. The over-drive compensation device according to claim 7, wherein the first conversion matrix and the second conversion matrix are inverse matrices to each other.

11. The over-drive compensation device according to claim 7, wherein the generator is an adder.

12. The over-drive compensation device according to claim 7, wherein the three primary color over-drive gain values are represented as $$\begin{cases} \Delta_R = r_y \Delta_Y \\ \Delta_G = g_y \Delta_Y \\ \Delta_B = b_y \Delta_Y \end{cases},$$

wherein $\alpha_R$, $\Delta_G$ and $\Delta_B$ are the three primary color over-drive gain values, $\Delta_Y$ is the luminance over-drive gain value, and $r_y$, $g_y$ and $b_y$ are three primary color luminance conversion coefficients.

* * * * *